US008095046B2

(12) United States Patent
Kasai

(10) Patent No.: US 8,095,046 B2
(45) **Date of Patent: *Jan. 10, 2012**

(54) IMAGE FORMING APPARATUS AND IMAGE DEVELOPER USED THEREIN

(75) Inventor: Tadashi Kasai, Yamato (JP)

(73) Assignee: Ricoh Company Limited, Tokyo (JP)

( * ) Notice: Subject to any disclaimer, the term of this patent is extended or adjusted under 35 U.S.C. 154(b) by 668 days.

This patent is subject to a terminal disclaimer.

(21) Appl. No.: 12/203,422

(22) Filed: Sep. 3, 2008

(65) Prior Publication Data

US 2009/0074439 A1 Mar. 19, 2009

(30) Foreign Application Priority Data

Sep. 13, 2007 (JP) ..... 2007-237415

(51) Int. Cl.
*G03G 15/08* (2006.01)

(52) U.S. Cl. ..... 399/254; 399/265

(58) Field of Classification Search ..... 399/254–256, 399/259

See application file for complete search history.

(56) References Cited

U.S. PATENT DOCUMENTS

| | | | | |
|---|---|---|---|---|
| 5,881,345 | A * | 3/1999 | Yamane et al. | 399/255 |
| 6,887,636 | B2 | 5/2005 | Matsuda et al. | |
| 6,899,986 | B2 | 5/2005 | Aoki et al. | |
| 6,934,484 | B2 | 8/2005 | Suzuki et al. | |
| 7,125,638 | B2 | 10/2006 | Suzuki et al. | |
| 7,150,954 | B2 | 12/2006 | Aoki et al. | |
| 7,162,187 | B2 | 1/2007 | Koichi et al. | |
| 7,273,688 | B2 | 9/2007 | Suzuki et al. | |
| 7,764,887 | B2 * | 7/2010 | Kasai | 399/27 |
| 2005/0030595 | A1 | 2/2005 | Koichi et al. | |
| 2005/0260003 | A1 * | 11/2005 | Tezuka | 399/15 |
| 2006/0002724 | A1 * | 1/2006 | Fujimori et al. | 399/27 |
| 2006/0029435 | A1 | 2/2006 | Kasai et al. | |
| 2006/0165422 | A1 * | 7/2006 | Kikuchi et al. | 399/13 |
| 2007/0253720 | A1 | 11/2007 | Kasai | |
| 2007/0286652 | A1 | 12/2007 | Suzuki et al. | |
| 2008/0138094 | A1 | 6/2008 | Shiori et al. | |

FOREIGN PATENT DOCUMENTS

| | | |
|---|---|---|
| JP | 2004-205535 | 7/2004 |
| JP | 2007-79489 | 3/2007 |

* cited by examiner

*Primary Examiner* — David Gray
*Assistant Examiner* — Rodney Bonnette
(74) *Attorney, Agent, or Firm* — Oblon, Spivak, McClelland, Maier & Neustadt, L.L.P.

(57) ABSTRACT

An image forming apparatus, including a surface-traveling latent image bearer bearing a latent image on the surface thereof; an image developer feeding a toner in a two-component developer including the toner and a carrier to the latent image in a developing area facing the latent image bearer to develop the latent image to form a toner image, including a developer stirrer and feeder circulating the two-component developer in circulation paths while stirring the two-component developer, including a driver independently driving the first and the second stirring and feeding members; a transferer transferring the toner image onto a recording material; and a controller controlling the driver such that an amount of the two-component developer fed by the second stirring and feeding member per unit time is relatively larger than that of the two-component developer fed by the first stirring and feeding member when a predetermined increase condition of stirring is satisfied.

6 Claims, 6 Drawing Sheets

IMAGE FORMING APPARATUS AND IMAGE DEVELOPER USED THEREIN

BACKGROUND OF THE INVENTION

1. Field of the Invention

The present invention relates to an image forming apparatus such as a copier, a printer and a facsimile using a two-component developer including a toners and a carrier, and to an image developer used therein.

2. Discussion of the Background

Typically, in an image forming apparatus using a two-component developer (hereinafter referred to as a "developer"), a toner consumed for development is fed into the developer and the developer is stirred to recover the concentration of the toner of the developer in the image developer and perform constant developability even when time passes. Recently, the image developer includes circulation paths including at least a first path the developer fed onto the surface of a developer bearer passes through and a second path connected with the first path directly or through another path. The image developer stirs the developer in the second path and feed the developer to the first path to be fed onto the surface of a developer bearer. Therefore, the image developer has deviation of toner concentration in the developer due to insufficient stir less than an image developer having none of such circulation paths. However, even the image developer including the circulation paths has a deviation of toner concentration in the developer unless the developer is fully stirred on the second path.

Japanese published unexamined application No. 2004-205535 discloses an image developer including a circulation path, in which a mesh member is fitted between blades of a stirring and feeding screw. When the stirring and feeding screw rotates, the developer is fed in the rotational axial direction of the stirring and feeding screw and passed through the mesh member for plural times. Therefore, the dispersibility of a toner in the developer can be improved and the deviation of the toner concentration therein can be reduced.

Recent image forming apparatuses are becoming smaller, and an image forming engine has smaller capacity, resulting in difficulty of obtaining a space for containing a developer in the image developer. On the other hand, it is necessary to obtain a space for containing a developer in the image developer to a degree. Consequently, in the image developer, each path in a developer container containing the developer is mostly occupied with the developer and does not have sufficient vacant space. When the path in the developer container does not have sufficient vacant space, the developer cannot widely move even when stirred and the developers in separated places are difficult to exchange each other. Therefore, even the image developer disclosed in Japanese published unexamined application No. 2004-205535 cannot obtain a sufficient stirring effect when having insufficient vacant spaces, resulting in difficulty of reducing the deviation of the toner concentration.

Because of these reasons, a need exists for an image forming apparatus capable of obtaining a sufficient stirring effect of the developer even when having insufficient vacant spaces in the paths in the developer container.

SUMMARY OF THE INVENTION

Accordingly, an object of the present invention is to provide an image forming apparatus capable of obtaining a sufficient stirring effect of the developer even when having insufficient vacant spaces in the paths in the developer container.

Another object of the present invention is to provide an image developer used in the image forming apparatus.

These objects and other objects of the present invention, either individually or collectively, have been satisfied by the discovery of an image forming apparatus, comprising:

a latent image bearer configured to bear a latent image on the surface and move the surface;

an image developer configured to feed a toner in a two-component developer comprising the toner and a carrier to the latent image in a developing area facing the latent image bearer to develop the latent image and to form a toner image, wherein the image developer comprises:

a developer container configured to contain the two-component developer, comprising circulation paths comprising a first path through which the developer fed onto the surface of the developer bearer passes and a second path connected with the first path directly or through another path; and a developer bearer configured to bear the two-component developer on the surface, to pass the two-component developer through the developing area and to return the two-component developer into the developer container;

a transferer configured to transfer the toner image onto a recording material;

wherein the image developer further comprises a developer stirrer and feeder configured to circulate the two-component developer in the circulation paths while stirring the two-component developer, wherein the developer stirrer and feeder comprises:

a first stirring and feeding member configured to feed the two-component developer in the first path;

a second stirring and feeding member configured to feed the two-component developer in the second path; and a driver configured to independently drive the first and the second stirring and feeding members; and a controller configured to control the driver such that an amount of the two-component developer fed by the second stirring and feeding member per unit time is relatively larger than that of the two-component developer fed by the first stirring and feeding member when a predetermined increase condition of stirring is satisfied.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present invention provides an image forming apparatus capable of obtaining a sufficient stirring effect of the developer even when having insufficient vacant spaces in the paths in the developer container. More particularly, the present invention provides an image forming apparatus, comprising:

a latent image bearer configured to bear a latent image on the surface and move the surface;

an image developer configured to feed a toner in a two-component developer comprising the toner and a carrier to the latent image in a developing area facing the latent image bearer to develop the latent image and to form a toner image, wherein the image developer comprises:

a developer container configured to contain the two-component developer, comprising circulation paths comprising a first path through which the developer fed onto the surface of the developer bearer passes and a second path connected with the first path directly or through another path; and a developer bearer configured to bear the two-component developer on the surface, to pass the two-component developer through the developing area and to return the two-component developer into the developer container;

a transferer configured to transfer the toner image onto a recording material;

wherein the image developer further comprises a developer stirrer and feeder configured to circulate the two-component developer in the circulation paths while stirring the two-component developer, wherein the developer stirrer and feeder comprises:

a first stirring and feeding member configured to feed the two-component developer in the first path;

a second stirring and feeding member configured to feed the two-component developer in the second path; and a driver configured to independently drive the first and the second stirring and feeding members; and a controller configured to control the driver such that an amount of the two-component developer fed by the second stirring and feeding member per unit time is relatively larger than that of the two-component developer fed by the first stirring and feeding member when a predetermined increase condition of stirring is satisfied.

In the present invention, an amount of the two-component developer fed by the second stirring and feeding member per unit time is relatively larger than that of the two-component developer fed by the first stirring and feeding member when a predetermined increase condition of stirring is satisfied. Then, an amount of the developer in the first path is larger than that of the developer in the second path, and a vacant space therein increases. Therefore, in the second path, the second stirring and feeding member enables the developer to widely move, and exchanges of the developers separating from each other are accelerated to obtain a high stirring effect.

Hereinafter, an electrophotographic printer (hereinafter referred to as a "printer") as an embodiment of the image forming apparatus of the present invention.

Figure 1:
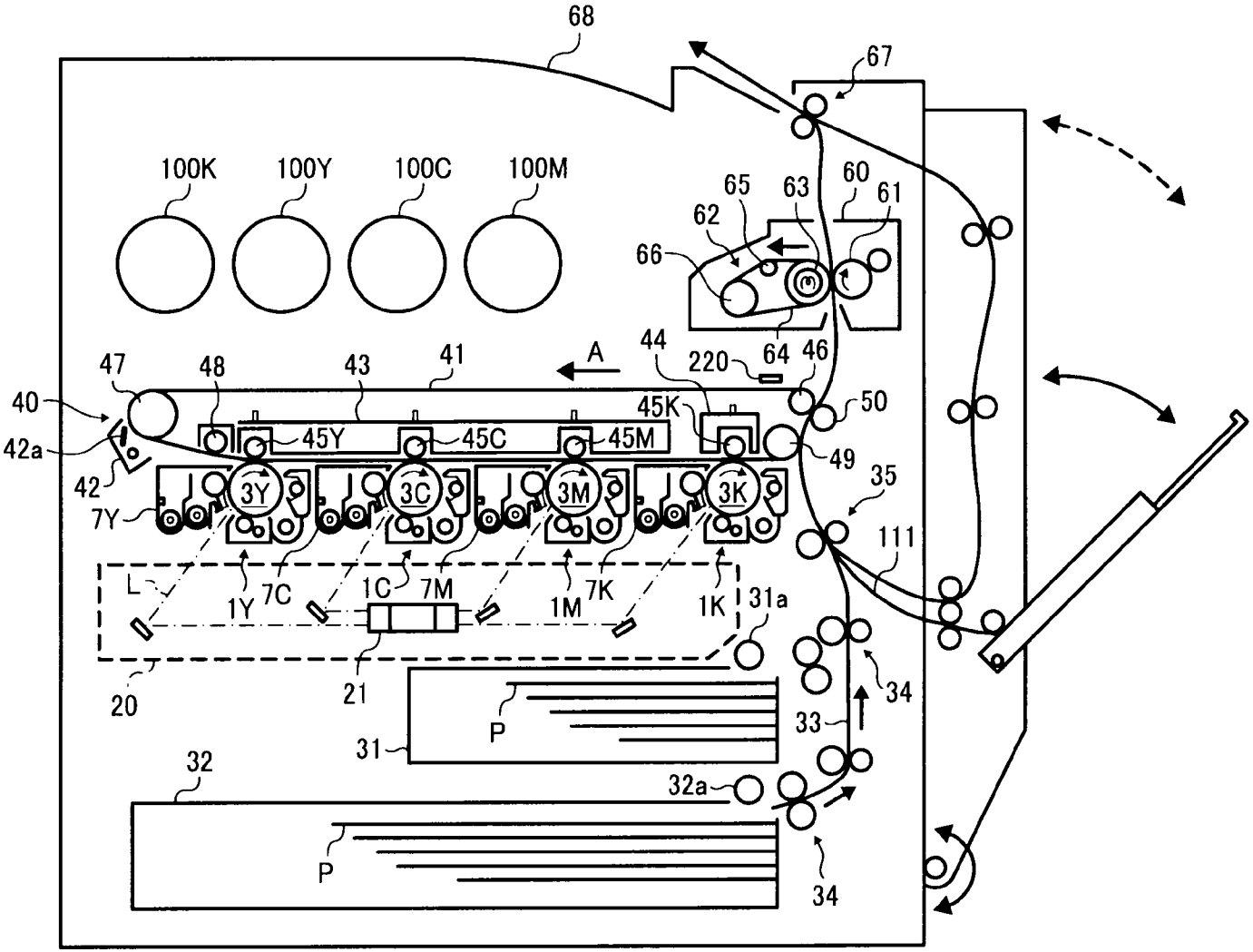
FIG. 1 is a schematic view illustrating a longitudinal section of a printer which is an embodiment of the present invention.

FIG. 1 is a schematic view illustrating a longitudinal section of a printer which is an embodiment of the present invention.

The printer includes four toner image forming process units 1Y, 1C, 1M and 1K for yellow, magenta, cyan and black (hereinafter referred to as Y, M, C and K) toner images, respectively. These have same constitutions except for using Y, M, C and K toners having different colors each other as image forming substances.

As shown in FIG. 2*m* the process unit 1Y includes a photoreceptor unit 2Y and a developing unit 7Y. These photoreceptor unit 2Y and developing unit 7Y are detachable from the printer in a body. The developing unit 7Y is detachable from the photoreceptor unit 2Y when they are out of the printer.

Figure 2:
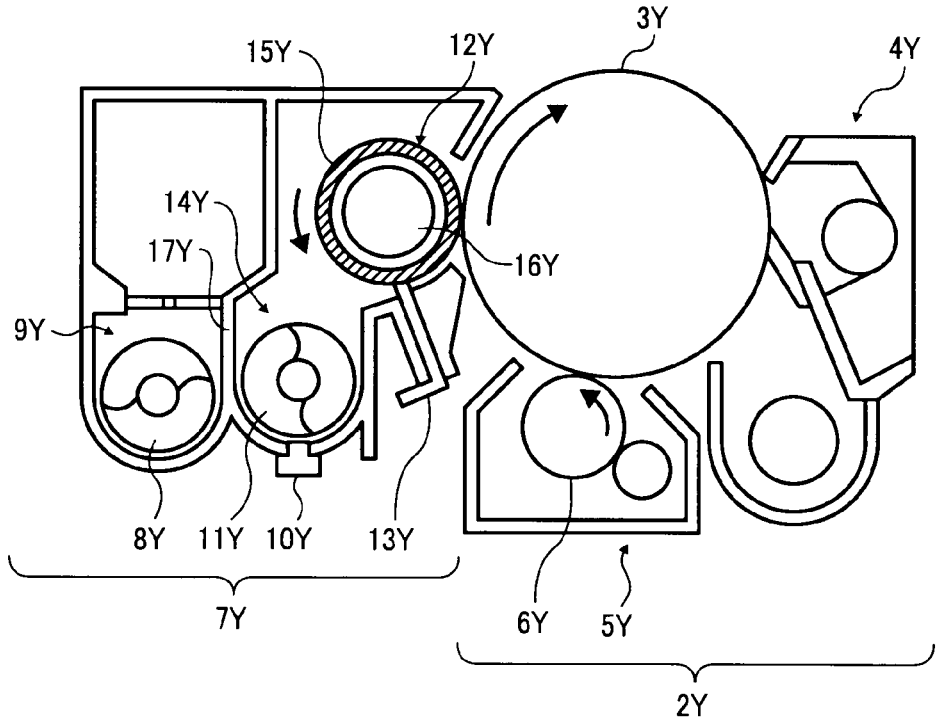
FIG. 2 is a schematic view illustrating an embodiment of a process unit of the printer in FIG. 1.

In FIG. 2, the photoreceptor unit 2Y includes a drum-shaped photoreceptor 3Y as a latent image bearer, a drum cleaner 4Y, a discharger (not shown), a charger 5Y, etc.

The charger 5Y negatively and uniformly charged the surface of the photoreceptor 3Y driven to rotate clockwise by a driver (not shown). The charger 5Y places a charging roller 6Y driven to rotate anticlockwise while applied with a charging bias by an electric source (not shown) close to the photoreceptor 3Y to uniformly charge the photoreceptor 3Y. A charging brush may be contacted thereto instead of the charging roller. In addition, the photoreceptor 3Y may be uniformly charged by a charger such as scorotron chargers. The surface of the photoreceptor 3Y uniformly charged by the charger 5Y is scanned with a laser irradiation emitted by an irradiation unit mentioned later to bear an electrostatic latent Y image.

Figure 3:
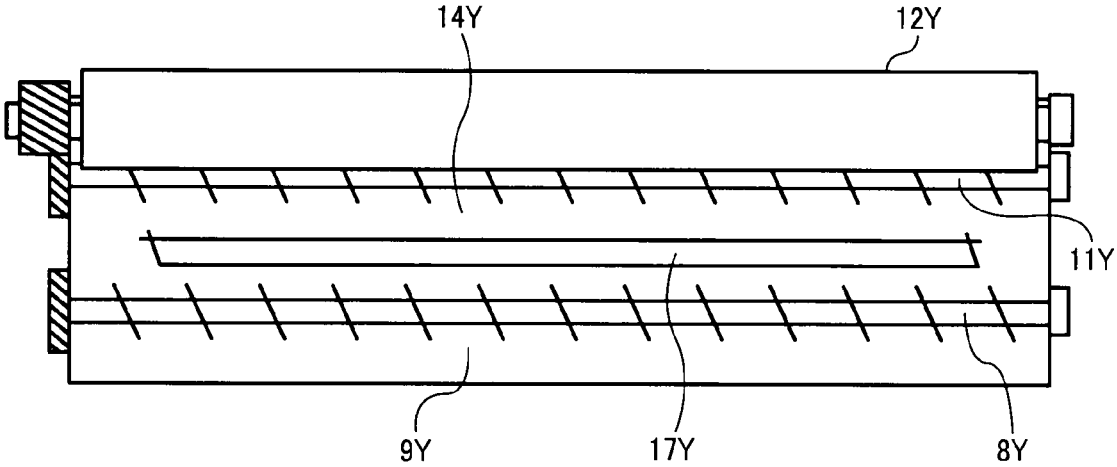
FIG. 3 is a schematic top view illustrating an inside of a developing unit in FIG. 2.

The developing unit 7Y as a developing means has a second developer container 9Y as a second path forming a part of a developer container including a second feeding screw 8Y as a second stirring and feeding member as FIGS. 2 and 3 show. In addition, the developing unit 7Y also has a first developer container 14Y as a first path forming a part of the developer container including a toner concentration sensor 10Y formed of a permeability sensor, a first feeding screw 11Y as a first stirring and feeding member, a developing roll 12Y, a doctor blade 13Y, etc. The two developer containers include a Y developer (not shown) including a magnetic carrier and negatively-chargeable Y toner. The second feeding screw 8Y is driven to rotate by a driver (not shown) to feed the Y developer in the second developer container 9Y from the near side to the other side in a direction perpendicular to the drawing. Then, the Y developer enters the first developer container 14Y through a continuous opening (not shown) formed on a division wall 17Y between the second developer container 9Y and the first developer container 14Y.

The first feeding screw 11Y in the first developer container 14Y is driven to rotate by a driver (not shown) to feed the Y developer from the near side to the other side in a direction perpendicular to the drawing. While the Y developer is fed, a toner concentration thereof is detected by the toner concentration sensor 10Y fixed on the bottom of the first developer container 14Y. Above the first feeding screw 11Y feeding the Y developer, the developing roll 12Y is located parallel to the first feeding screw 11Y. The developing roll 12Y includes a developing sleeve 15Y driven to rotate anticlockwise and formed of a non-magnetic pipe, and a magnet roller 16Y included in the developing sleeve 15Y. A part of the Y developer fed by the first feeding screw 11Y is drawn onto the surface of the developing sleeve 15Y with magnetization generated by the magnet roller 16Y. After the layer thickness of the developer Y is regulated by the doctor blade 13Y holding a predetermined gap between the developing sleeve 15Y and the doctor blade 13Y, the developer Y is fed to a developing area facing the photoreceptor 3Y and transfers the Y toner to an electrostatic Y latent image on the photoreceptor 3Y. Thus, a Y toner image is formed thereon. The developer Y having consumed the Y toner is returned onto the first feeding screw 11Y accompanied with the rotation of the developing sleeve 15Y of the developing roll 12Y. Then, when the developer Y is fed to the near side end of the drawing, the developer Y is returned in the second developer container 9Y through a continuous opening (not shown). Thus, the developer is circulated in the developing unit 7Y through the first developer container 14Y and the second developer container 9Y.

The result of the permeability of the Y developer, detected by the toner concentration sensor 10Y is sent to a controller (not shown) as a voltage signal. Since the permeability of the Y developer is correlative to the Y toner concentration thereof, the toner concentration sensor 10Y produces a voltage in accordance with the toner concentration. The controller includes a RAM including a Y Vtref which is a desires value of the output voltage from the toner concentration sensor 10Y, and a C Vtref, a M Vtref and a K Vtref which are a desired values of the output voltages from toner concentration sensors installed in other developing units for C, M and K. The output voltage value from the toner concentration sensor 10Y is compared with the Y Vtref to drive a Y toner feeder (not shown) for a time in accordance with the comparison result. Thus, a suitable amount of the Y toner is fed to the Y developer having consumed the Y toner for development in the second developer container 9Y. Therefore, the Y toner concentration of the Y developer in the first developer container 14Y is maintained in a predetermined range. In other process units 1C, 1M and 1K, toners C, M and K are similarly controlled to feed to respective developers.

In FIG. 1, an irradiation unit 20 is located below the process units 1Y, 1C, 1M and 1K. The irradiation unit 20 irradiates the photoreceptors 3Y, 3C, 3M and 3K of the respective process units 1Y, 1C, 1M and 1K with a laser beam L based on image information. Thus, potentials of the irradiated parts on the photoreceptors 3Y, 3C, 3M and 3K decay and electrostatic latent images for Y, C, M and K having negative polar potentials lower than those of non-image areas around the irradiated parts are formed on the photoreceptors 3Y, 3C, 3M and 3K. The irradiation unit 20 irradiates the photoreceptors 3Y, 3C, 3M and 3K with the laser beam L though plural lenses and mirrors while deflecting the laser beam L emitted from a light source with a polygon mirror 21 driven to rotate by a motor. Instead of such a configuration, the photoreceptors 3Y, 3C, 3M and 3K may be optically scanned with a LED array.

In FIG. 2, the insulative developing sleeve 15Y is applied with a developing bias having negative polarity and an intermediate value between the electrostatic latent image potential and the non-image area potential by a voltage applicator (not shown). Thus, in the developing area where the developing sleeve 15Y and the photoreceptor 3Y face each other, a developing electric field is formed between the electrostatic latent image on the photoreceptor 3Y and the developing sleeve 15Y, which electrostatically transfers a toner from the sleeve to the latent image. The electrostatic latent image on the photoreceptor 3Y is developed to a Y toner image with adherence of the Y toner electrostatically transferred from the sleeve by the developing electric field.

The Y toner image formed on the photoreceptor 3Y is intermediately transferred onto an intermediate transfer belt mentioned later. The drum cleaner 4Y of the photoreceptor unit 2Y removes a toner remaining on the surface of the photoreceptor 3Y after the intermediate transfer process. Then, the surface of the photoreceptor 3Y is discharged by a discharger (not shown) after cleaned, and is initialized to be ready for a forming a following image. In FIG. 1, in the other process units 1C, 1M and 1K, C, M and K toner images are formed on the photoreceptors 3C, 3M and 3K and transferred onto the intermediate transfer belt.

A first paper feeding cassette 31 and a second paper feeding cassette 32 are located below the irradiation unit 20 while vertically stacked. Each of the paper feeding cassettes contains plural stacked recording papers P as a recording paper bundle, and a first paper feeding roller 31*a* and second paper feeding roller 32*a* contact the uppermost recording paper P. When the first paper feeding roller 31*a* is rotated anticlockwise by a driver (not shown), the uppermost recording paper P in the first paper feeding cassette 31 is discharged toward a paper feeding path 33 vertically extended up on the right side of the cassette. When the second paper feeding roller 32*a* is rotated anticlockwise by a driver (not shown), the uppermost recording paper P in the first paper feeding cassette 32 is discharged toward the paper feeding path 33. The paper feeding path 33 includes plural pairs of feeding rollers 34, and a recording paper P sent into the paper feeding path 33 is transported upward therein while sandwiched among the pairs of feeding rollers 34.

A pair of registration rollers 35 is located at the end of the paper feeding path 33. The pair of registration rollers 35 pauses rotation of the rollers on sandwiching a recording paper P therebetween, and sends out the recording paper P toward a second transfer nip mentioned later at the right time.

A transfer unit 40 as a transferer endlessly rotating an intermediate transfer belt 41 as an image bearer in an anticlockwise direction indicated by an arrow A while extending and suspending the intermediate transfer belt 41 is located above the process units 1Y, 1C, 1M and 1K. The transfer unit 40 includes a belt cleaning unit 42, a first bracket 43, a second bracket 44, etc. besides the intermediate transfer belt 41. In addition, the transfer unit 40 also includes four first transfer rollers 45Y, 45C, 45M and 45K, a second transfer backup roller 46, a drive roller 47, an assist roller 48, a tension roller 49, etc. The intermediate transfer belt 41 is endlessly rotated anticlockwise by the drive roller 47 while extended and suspended by these rollers. An illustration of apart of the assist roller 48 is omitted.

The four first transfer rollers 45Y, 45C, 45M and 45K are located so as to press the endlessly rotating intermediate transfer belt 41 to the photoreceptors 3Y, 3C, 3M and 3K. Thus, a first transfer nip is formed between each of the photoreceptors 3Y, 3C, 3M and 3K and the intermediate transfer belt 41.

A charge having a polarity (positive polarity) reverse to a regular charged polarity (negative polarity) of a toner is applied to the backside (inner circumferential surface) of the intermediate transfer belt 41 to form a transfer electric field in each of the first transfer nips for transferring toner images on the photoreceptors 3Y, 3C, 3M and 3K onto the surface of the intermediate transfer belt 41. In the process of passing the first transfer nips of the intermediate transfer belt 41 accompanied with its endless rotation, the Y, M, C and K toner images on the photoreceptors 3Y, 3C, 3M and 3K are first transferred onto the (outer) surface of the intermediate transfer belt 41 while overlapped. Thus, four color toner images are overlapped to form a synthesized toner image on the intermediate transfer belt 41.

The second transfer backup roller 46 forms a second transfer nip with a second transfer roller 50 contacting the surface (outer circumferential surface) of the intermediate transfer belt 41, sandwiching the intermediate transfer belt 41 therebetween. The pair of registration rollers 35 sends out the recording paper P sandwiched between the rollers toward the second transfer nip to be synchronized with the synthesized toner image on the intermediate transfer belt 41.

The second transfer roller 50 sandwiching the intermediate transfer belt 41 with the second transfer backup roller 46 applies a second transfer bias having a polarity reverse to that of a toner to the surface of the intermediate transfer belt 41. The synthesized toner image on the intermediate transfer belt 41 is second transferred onto a recording paper P at a time in the second transfer nip because of a second transfer electric field formed between the second transfer roller 50 and the second transfer backup roller 46 with the second transfer bias and a nip pressure. Then, a full-color toner image is formed on the recording paper P in combination with white color thereof.

An untransferred residual toner adheres to the intermediate transfer belt 41 after passed through the second transfer nip. This is cleaned by the belt cleaning unit 42. The belt cleaning unit 42 contacts a cleaning blade 42*a* to the outer surface of the intermediate transfer belt 41 to scrape and remove the untransferred residual toner on the belt.

The first bracket 43 of the transfer unit 40 oscillates at a predetermined rotation angle around a rotation axis of the assist roller 48 located at the leftmost side with on and off of driving a solenoid (not shown). The printer makes the solenoid drive to rotate the first bracket 43 anticlockwise a bit when forming a monochrome image. Thus, the first transfer rollers 45Y, 45C and 45M rotate anticlockwise around the rotation axis of the assist roller 48 to separate the intermediate transfer belt 41 from the photoreceptors 3Y, 3C and 3M. Then, only the process unit 1K of the four process units 1Y, 1C, 1M and 1K is driven to form a monochrome image. Therefore, the consumption of the process units 1Y, 1C and 1M due to useless drive when a monochrome image is formed can be avoided. A fixing unit 60 is located above the second transfer nip. The fixing unit 60 includes a pressure and heat roller 61 including a heat source such as halogen lamps, and a fixing belt unit 62. The fixing belt unit 62 includes a fixing belt 64 as a fixing member, a heat roller 63 including a heat source such as halogen lamps, a tension roller 65, a drive roller 66, a temperature sensor (not shown), etc. The endless fixing belt 64 endlessly rotates anticlockwise while extended and suspended by the heat roller 63, the tension roller 65 and the drive roller 66. The fixing belt 64 is heated from the backside thereof by the heat roller 63 in the process of this endless rotation. The pressure and heat roller 61 driven to rotate clockwise contacts the outer surface of the thus heated fixing belt 64, facing the heat roller 63. Thus, a fixing nip where the pressure and heat roller 61 and the fixing belt 64 contact each other is formed.

On the outside of the fixing belt 64, the temperature sensor (not shown) is located facing the outer surface of the fixing belt 64 with a predetermined gap therebetween and detects the surface temperature of the fixing belt 64 just before entering the fixing nip. The detection result is sent to a fixing electric source circuit (not shown). The fixing electric source circuit controls supplying electric to the heat source included in the heat roller 63 or the pressure and heat roller 61, based on the detection result of the temperature sensor. Thus, the surface temperature of fixing belt 64 is maintained at 140° C.

A recording paper P having passed through the second transfer nip is fed into the fixing unit 60 after separating from the intermediate transfer belt 41. A synthesized full-color toner image is fixed on the recording paper P by being heated and pressed by the fixing belt 64 in the process of being fed upward while sandwiched by the fixing nip in the fixing unit 60.

After passing between a pair of paper discharge rollers 67, the recording paper P a full-color toner image is fixed on is discharged out of the printer. A stacker 68 is formed on the upper surface of the chassis of the printer, and recording papers P discharged out of the printer by the pair of paper discharge rollers are sequentially stacked on the stacker 68.

Above the transfer unit 40, four toner cartridges 100Y, 100C, 100M and 100K containing Y, C, M and K toners, respectively are located. The Y, C, M and K toners in the toner cartridges 100Y, 100C, 100M and 100K are suitably supplied to the respective developing units 7Y, 7C, 7M and 7K of the process units 1Y, 1C, 1M and 1K. These toner cartridges 100Y, 100C, 100M and 100K are detachable from the printer independently of the process units 1Y, 1C, 1M and 1K.

In this embodiment, the photoreceptor has a surface migration speed (linear speed) of 180 mm/sec, a developer used therein includes a ferrite carrier having a weight-average particle diameter of 35 μm and a toner having a targeted concentration about 7% by weight, and a DC bias is used as a developing bias.

Next, the drive control of the second feeding screw of the developing unit which is a feature of the present invention will be explained. The drive control in any of the developing units is the same, and the color codes Y, C, M and K are omitted in the following explanation.

Figure 4:
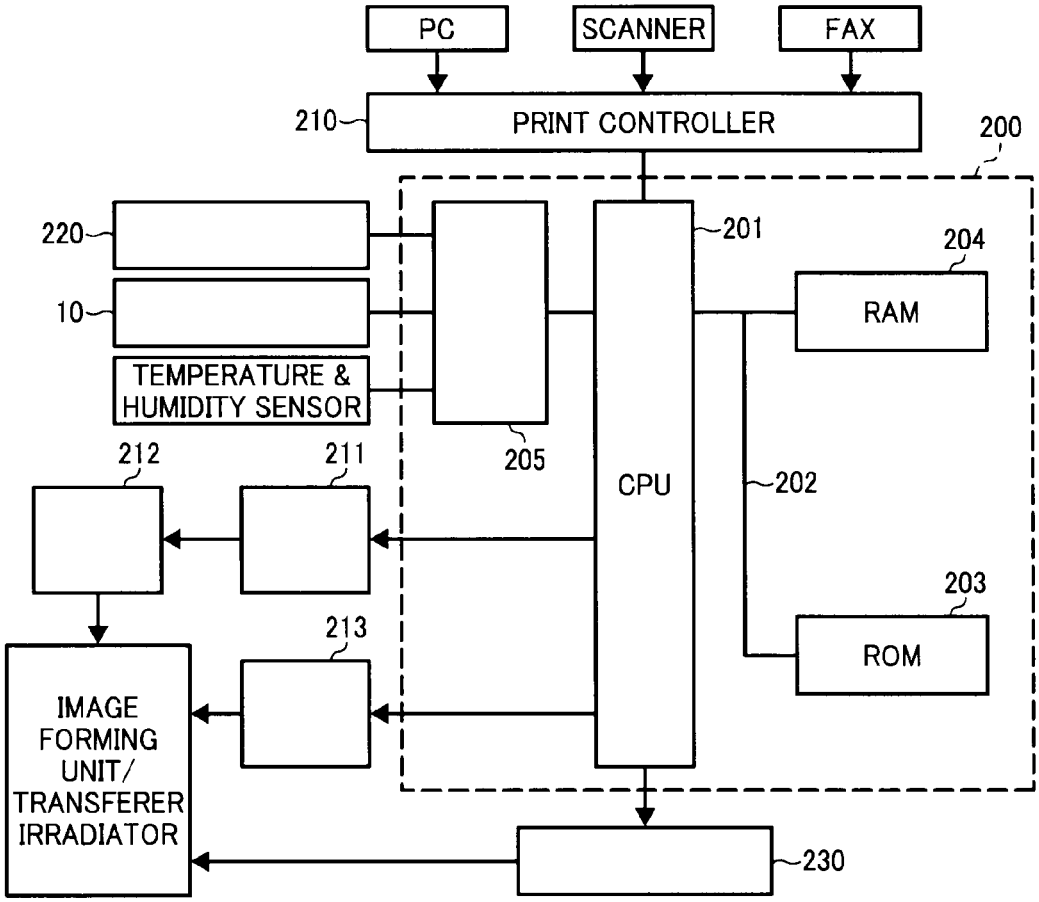
FIG. 4 is a control block diagram of the main part of the printer in FIG. 1.

FIG. 4 is a control block diagram of the main part of the printer in FIG. 1.

The printer includes a computerized integrated controller 200 controlling each section.

The integrated controller 200 includes a CPU (Central Processing Unit) 201 performing various computations and drive controls of each section, which a ROM (Read Only Memory) 203 previously memorizing fixed data such as computer programs and a RAM (Random Access Memory) 204 functioning as a work area rewritably memorizing various data are connected to through a bus line 202. The ROM 203 stores information of a test pattern forming position and density, bias conditions forming gradation thereof, and an adherence conversion LUT (Look Up Table) produced by a toner adherence amount sensor (TM/P sensor) assuming an adherence amount thereof required to generate a test pattern. A print controller 210 is connected to the integrated controller 200, which transmits unified image data from a personal computer (PC), a facsimile (FAX), scanner, etc. to the integrated controller 200. In addition, an A/D converting circuit 205 converting various sensor information into digital date, a driver 211 driving systems such as motors and clutches, and a high-voltage generator 213 generating a voltage required to form an image, etc. are connected thereto.

Figure 5:
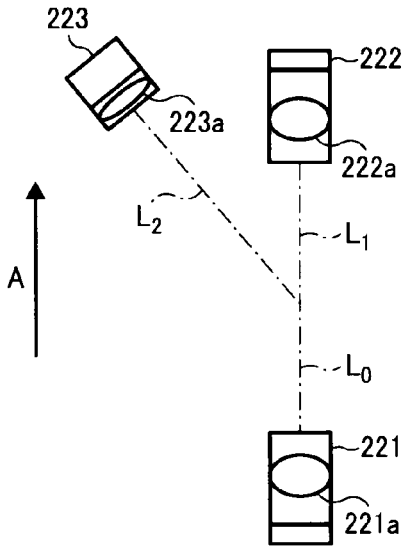
FIG. 5 is a schematic view for explaining a sensor detecting an adherence amount of a toner pattern formed on an intermediate transferer in the printer in FIG. 1.

FIG. 5 is a schematic view for explaining a sensor detecting an adherence amount of a toner pattern formed on the intermediate transfer belt 41 in the printer in FIG. 1.

In this embodiment, the toner adherence amount sensor (TM/P sensor) 220 formed of an inexpensive optical sensor is typically used as a detector detecting an adherence amount of a toner pattern formed on the intermediate transfer belt 41, however, other means may be used. In this embodiment, two toner adherence amount sensors 220 are located facing each other on different positions on the intermediate transfer belt 41 in a direction perpendicular to a surface traveling direction A thereof. The toner adherence amount sensors 220 includes an infrared LED 221 as a light-emitting part irradiating light $L_0$ to the surface of the intermediate transfer belt 41, a normally-reflected light receiving element 222 as a light receiver located at a position capable of receiving light $L_1$ specularly reflected (normally reflected) on the surface of the intermediate transfer belt 41, and a diffusely-reflected light receiving element 223 as a light receiver located at a position not receiving the normally-reflected light and receiving diffusely-reflected light $L_2$ diffusely reflected on the surface of the intermediate transfer belt 41. Collecting lenses 221*a*, 222*a* and 223*a* are located on the light path. The light-emitting part may be other light-emitting elements such as lasers. Phototransistors are used as the light receiver, however, other light receivers such as amplified photodiodes may be used. In addition, the normally-reflected light receiving element and the diffusely-reflected light receiving element are both used, however, either of them may be used.

Figure 6A:
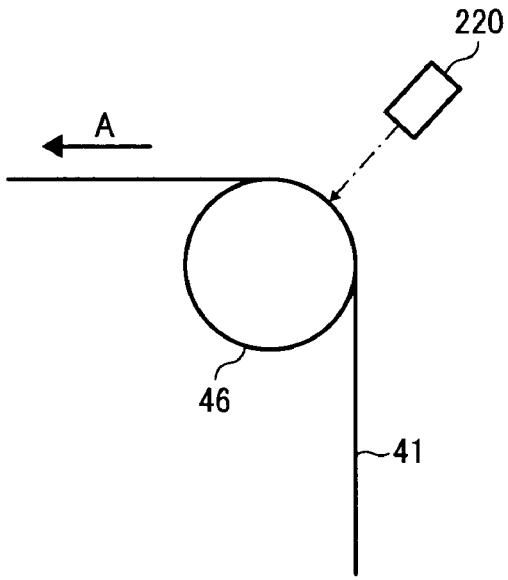
FIGS. 6A and 6B are schematic views for explaining locations of the sensors detecting the toner adherence amount, respectively.
Figure 6B:
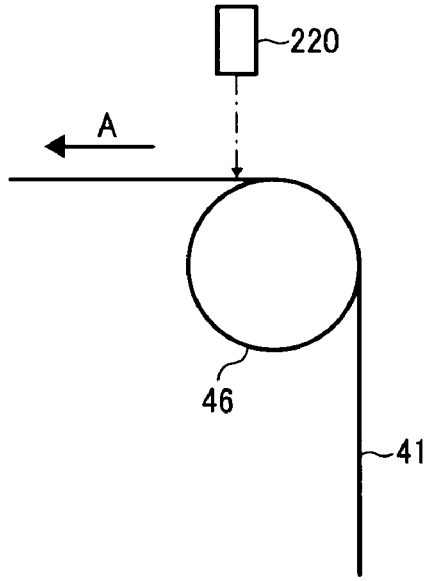
Figure 6C:
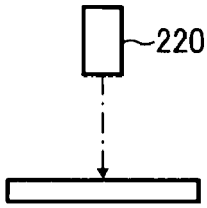
FIG. 6C is schematic view for explaining a location of the sensor detecting the toner adherence amount on a photoreceptor plate.
Figure 6D:
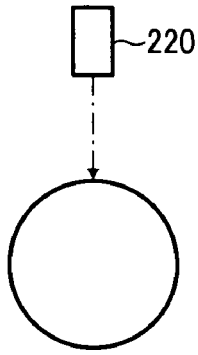
FIG. 6D is schematic view for explaining a location of the sensor detecting the toner adherence amount on a photoreceptor drum.

FIGS. 6A and 6B are schematic views for explaining locations of the toner adherence amount sensors. In FIG. 6A, a toner adherence amount sensor 220 is located so as to detect a part of the belt wound on extension and suspension rollers such as the second transfer backup roller 46. This location does not receive much influence of flops of the intermediate transfer belt 41, however, the light receiving sensitivity is likely to deteriorate because the reflecting surface of the intermediate transfer belt 41 is curved. On the other hand, in FIG. 6B, a toner adherence amount sensor 220 is located so as to detect a flat part of the belt close to and not wound on extension and suspension rollers such as the second transfer backup roller 46. This location is likely to receive an influence of flops of the intermediate transfer belt 41, however, the light receiving sensitivity is not likely to deteriorate because the reflecting surface of the intermediate transfer belt 41 is flat. The location of the toner adherence amount sensor 220 is properly fixed in consideration of these advantages and disadvantages. In this embodiment, a case where a toner adherence amount of a test pattern on the intermediate transfer belt 41 is detected is explained, however, a toner adherence amount on the photoreceptor or on the recoding paper P may be detected. FIG. 6C is schematic view for explaining a location of the sensor detecting the toner adherence amount on a photoreceptor plate, and FIG. 6D is schematic view for explaining a location of the sensor detecting the toner adherence amount on a photoreceptor drum.

In this embodiment, the following control is performed in the above constitution.

Figure 7:
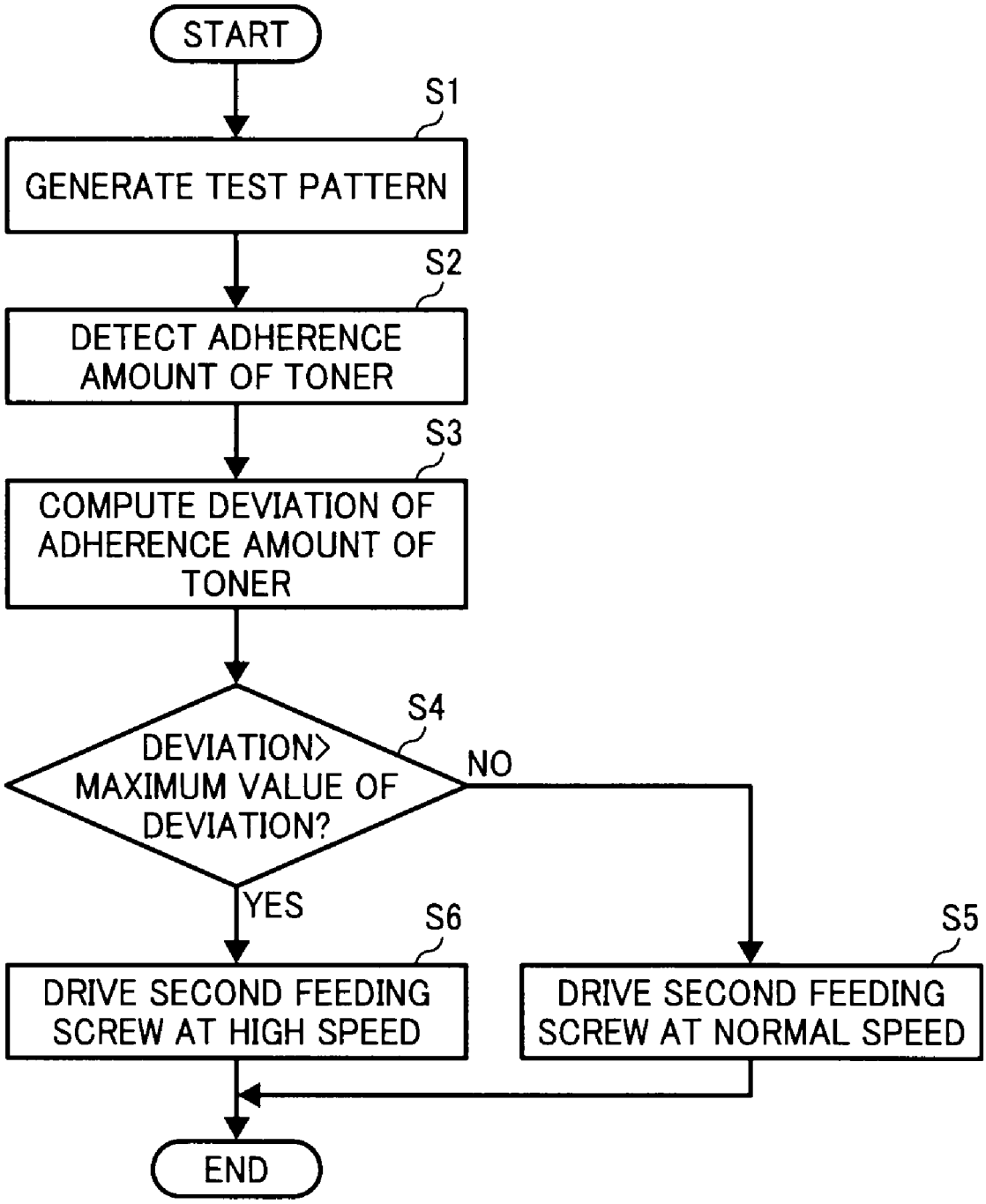
FIG. 7 is a flow chart showing a drive control of a second feeding screw in the developing unit in FIG. 3.

FIG. 7 is a flow chart showing a drive control of a second feeding screw in the developing unit in FIG. 3.

The CPU 201 of the integrated controller 200 runs a control program read out from the ROM 203 at a predetermined time, e.g., after a print job is finished or between-papers (between an image and another image during continuous printing), and orders the test pattern generator 230 to generate a test pattern at first. The test pattern generator 230 having received this order produces a signal for generating a test pattern. The irradiation unit 20 irradiates the photoreceptors 3Y, 3C, 3M and 3K with a laser beam for a test pattern to form an electrostatic latent image for a test pattern on positions of each thereof, different from each other in a direction perpendicular to a surface traveling direction of the photoreceptor. The electrostatic latent images are developed by the developing units 7Y, 7C, 7M and 7K to form a test pattern on each of the photoreceptors 3Y, 3C, 3M and 3K. The test patterns are transferred on the intermediate transfer belt 41 to form test patterns of each color on positions of the intermediate transfer belt 41, different from each other in a direction perpendicular to a surface traveling direction thereof (S1). Then, each of the test patterns is transported to an area where the two toner adherence amount sensors 220 are facing each other, and the toner adherence amounts of the test patterns of each color are detected by each of the toner adherence amount sensors 220 (S2).

The detection result of each of the test patterns detected by each of the toner adherence amount sensors 220 is sent to the CPU 201 through the A/D conversion circuit 205. The CPU 201 computes differences (deviations) of the toner adherence amounts of each color, detected by the toner adherence amount sensors 220 (S3). Then, the CPU 201 judges whether differences (deviations) of the toner adherence amounts of each color are over predetermined maximum deviations (specified values) memorized in the RAM 204 (S4). When the deviation of the toner adherence amount is not over the maximum deviation, the CPU 201 orders the driver 211 to drive the second feeding screw 8 of the developing unit of the color judged not to be over at a normal rotation speed. The driver 211 having received this order drives the second feeding screw 8 at a normal rotation speed (S5). On the contrary, when the deviation of the toner adherence amount is over the maximum deviation, the CPU 201 orders the driver 211 to drive the second feeding screw 8 of the developing unit of the color judged to be over at a rotation speed higher than normal. The driver 211 having received this order drives the second feeding screw 8 at a high rotation speed (S6).

Figure 8A:
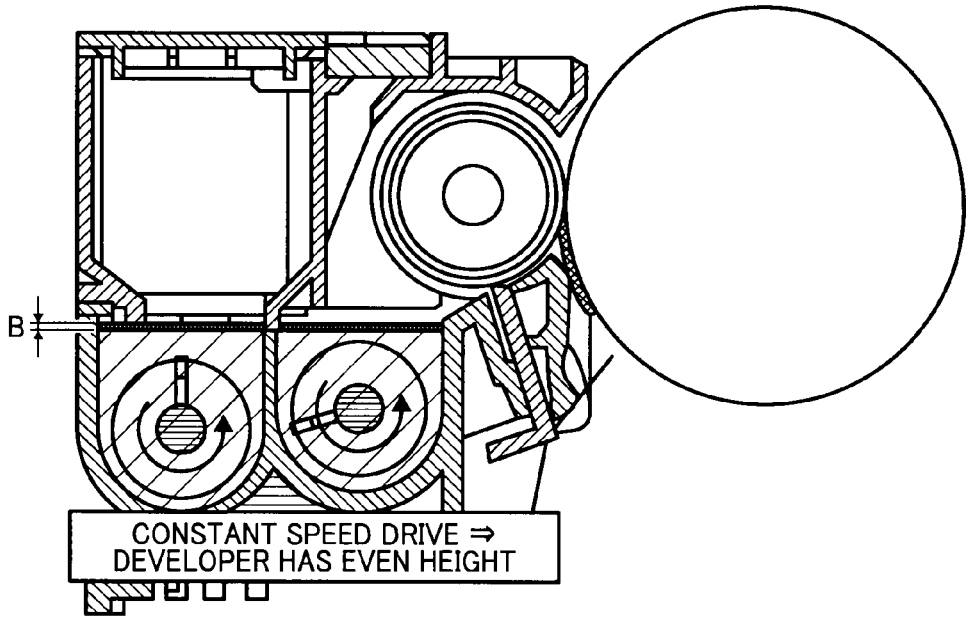
FIG. 8A is schematic view for explaining amounts of the developer in a first developer container and a second developer container when the second feeding screw rotates at normal rotation speed.
Figure 8B:
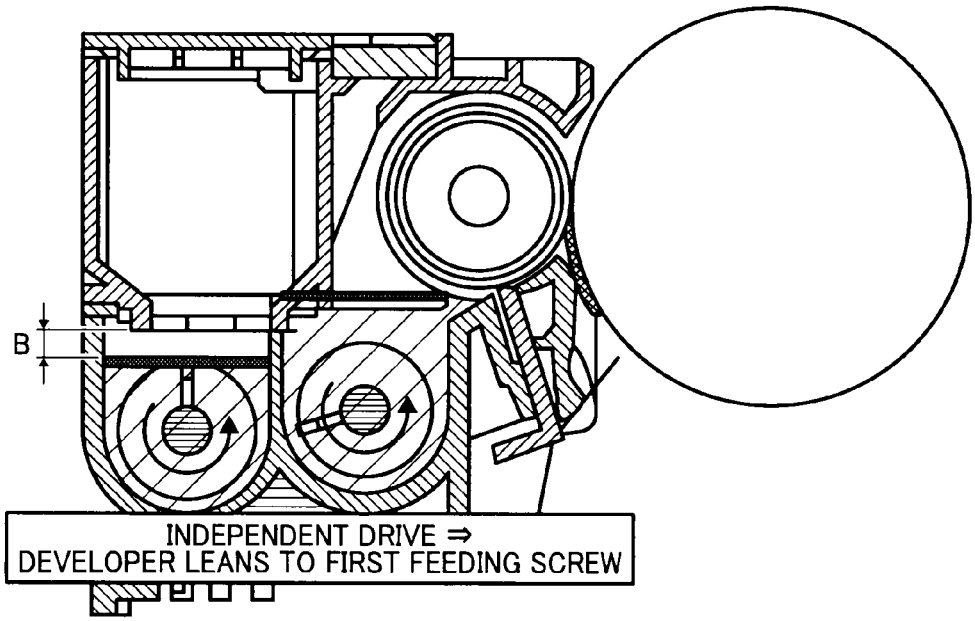
FIG. 8B is schematic view for explaining amounts of the developer in a first developer container and a second developer container when the second feeding screw rotates at high rotation speed.

FIG. 8A is schematic view for explaining amounts of the developer in a first developer container 14 and a second developer container 9 when the second feeding screw 8 rotates at normal rotation speed. FIG. 8B is schematic view for explaining amounts of the developer in a first developer container 14 and a second developer container 9 when the second feeding screw 8 rotates at high rotation speed. When the second feeding screw 8 rotates at normal rotation speed, the first feeding screw 11 rotates at the same speed as that of the second feeding screw 8. Having the same constitutions, the first feeding screw 11 and the second feeding screw 8 have the same feeding capacity. Namely, the first feeding screw 11 and the second feeding screw 8 have almost the same feeding amount of a two-component developer per unit hour. Therefore, as shown in FIG. 8A, the first developer container 14 and the second developer container 9 include almost same amount of the developer in the developing unit.

In this embodiment, the developing unit is small for smaller image forming apparatuses, and therefore amounts of developers containable in the first developer container 14 and the second developer container 9 are slightly larger than necessary. Therefore, the second developer container 9 is almost filled with a developer and has almost no vacant space B as shown in FIG. 8A. Therefore, a developer in the second developer container 9 cannot largely move even when stirred and the developers distant from each other are difficult to exchange, resulting in an insufficient stirring effect of the second feeding screw 8 even when rotated. The insufficient stirring effect in the in the second developer container 9 may feed an insufficiently-stirred developer to the first developer container 14, resulting in deterioration of the resultant image quality such as uneven image density.

As mentioned above, the deviation of the toner adherence amount is judged to over the maximum in S4, the CPU 201 recognizes a predetermined increase condition of stirring is satisfied and orders the driver 211 to drive the second feeding screw 8 at a high rotation speed (S6). Then, the second feeding screw 8 feeds the developer in an amount relatively larger than the first feeding screw 11 per unit hour. Consequently, the first developer container 14 contains the developer more than the second developer container 9 in the developing unit, and the vacant space B increases therein as shown in FIG. 8B. Thus, as and the vacant space B increases, the developer to widely move in the second developer container 9 and exchanges of the developers separating from each other are accelerated to obtain a sufficient stirring effect of the second feeding screw 8. In addition, the second feeding screw 8 rotating at a high speed assist the high stirring effect. As above, the sufficient stirring effect quickly resolves the toner concentration deviation.

As mentioned above, an embodiment of the image forming apparatus of the present invention is a printer including the surface-traveling photoreceptors 3Y, 3C, 3M and 3K each bearing a latent image on the surface as a latent image bearer, and developing units 7Y, 7C, 7M and 7K as developing means each providing a toner included in a developer formed of the toner and a carrier to the latent image on the photoreceptor in a developing area facing the photoreceptors 3Y, 3C, 3M and 3K to develop the latent image. The developing units 7Y, 7C, 7M and 7K each include the developer container and the developing sleeve 15 as a developer bearer passing the developer contained in the developer container through the developing area while bearing the developer on the surface thereof, and returning the developer having passed the developing area into the developer container. The developer container includes at least the first developer container 14 as a first feeding path the developer being fed onto the surface of the developing sleeve 15 passes and the second developer container 9 as a second feeding path the developer passes through, which is connected to the first developer container 14 directly or through another path. Finally, a toner image developed by the developing units 7Y, 7C, 7M and 7K is transferred onto the recording paper P as a recording material and fixed thereon. Each of the developing units 7Y, 7C, 7M and 7K includes a developer stirring and feeding means circulating the developer while stirring the developer in the developer container through the first developer container 14 and the second developer container 9. The developer stirring and feeding means includes the first feeding screw 11 as a first stirring and feeding member feeding the developer in the first developer container 14 while stirring the developer, the second feeding screw 8 as a second stirring and feeding member feeding the developer in the second developer container 9 while stirring the developer, the driver 211 capable of independently driving the first feeding screw 11 and the second feeding screw 8, and the integrated controller 200 as a controller controlling the driver 211 such that the second feeding screw 8 feeds the developer in an amount per unit hour relatively larger than the first feeding screw 11 when a predetermined increase condition of stirring is satisfied, i.e., when the deviation of the toner adherence amount is over the specified value. Thus, the amount of the developer in the second developer container 9 becomes larger than that in the first developer container 14. As a result, the second developer container 9 has more vacant space, and a high stirring effect can be obtained therein and the toner concentration deviation can quickly be resolved.

Particularly, the embodiment has the toner adherence amount sensor 220 as a detector detecting the toner adherence amounts after the toners having adhered on positions different from each other in a direction perpendicular to the surface traveling directions of each of the photoreceptors 3Y, 3C, 3M and 3K is transferred therefrom. The predetermined increase condition of stirring is a condition that the difference (deviation) of the toner adherence amounts of the toners on the positions different from each other is over the maximum deviation (specified value). Having a high correlation with the image density, the toner adherence amount sensor 220 can precisely detect an image density deviation and the developer is stirred at proper time. As a result, the developer is not stressed than necessary, which prevents the developer from having a shorter life. In addition, an inexpensive optical sensor can be used as the detector in the present invention.

Each of the first feeding screw 11 and the second feeding screw 8 has a rotation axis extending along the developer feeding direction and a blade fixed thereon. The rotation axis rotates to feed the developer with the blade along the axial direction of the rotation axis. The integrated controller 200 performs the above-mentioned drive control by changing the rotation speed of the second feeding screw 8. Such a simple control of changing the rotation speed reduces cost.

Changing the rotation speed of the second feeding screw 8 without changing that of the first feeding screw 11 does not impair the function thereof stirring and feeding the developer onto the surface of the developing sleeve 15, which influences less on the image development.

In addition, the rotation speed of the second feeding screw 8 has an allowable limit due to a balance between an amount of the developer in the first developer container 14 and an amount thereof in the second developer container 9. This limit depends on the constitution of the developing unit, etc.

A case where there is one predetermined increase condition of stirring has been explained, however, there may be two or more increase conditions of stirring with two or more specified values to change the rotation speed of the second feeding screw 8 in stages.

In addition, a case where a vacant space is formed in the second developer container 9 to increase a stirring effect of a developer therein has been explained, however, a vacant space may be formed in the first developer container 14 to increase a stirring effect of a developer therein. However, the vacant space is preferably formed when development is not made because the developer may not be fully provided on the developing sleeve 15. Forming a vacant space in the second developer container 9 to increase a stirring effect of a developer therein has an advantage in being performable even when development is made.

Further, a case where the rotation speed of the second feeding screw 8 is changed while the rotation speed of the first feeding screw 11 is maintained constant. However, the rotation speed of the first feeding screw 11 may be changed while the rotation speed of the second feeding screw 8 is maintained, or both of the rotation speeds may be changed. Namely, when a vacant space is formed in the second developer container 9, the rotation speed of the first feeding screw 11 may be lowered while the rotation speed of the second feeding screw 8 is maintained or the rotation speed of the first feeding screw 11 may be lowered while the rotation speed of the second feeding screw 8 is upped.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

This application claims priority and contains subject matter related to Japanese Patent Application No. 2007-237415 filed on Sep. 13, 2007, the entire contents of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming apparatus, comprising:

a surface-traveling latent image bearer configured to bear a latent image on the surface thereof;

an image developer configured to feed a toner in a two-component developer comprising the toner and a carrier to the latent image in a developing area facing the latent image bearer to develop the latent image to form a toner image, comprising:

a developer container configured to contain the two-component developer, comprising circulation paths comprising a first path through which the developer fed onto the surface of the developer bearer passes and a second path connected with the first path directly;

a developer bearer configured to bear the two-component developer on the surface, to pass the two-component developer through the developing area and to return the two-component developer into the developer container;

a developer stirrer and feeder configured to circulate the two-component developer in the circulation paths while stirring the two-component developer, comprising:

a first stirring and feeding member configured to feed the two-component developer in the first path;

a second stirring and feeding member configured to feed the two-component developer in the second path; and a driver configured to independently drive the first and the second stirring and feeding members;

a transferer configured to transfer the toner image onto a recording material; and a controller configured to control the driver such that an amount of the two-component developer fed by the second stirring and feeding member per unit time is relatively larger than that of the two-component developer fed by the first stirring and feeding member when a predetermined increase condition of stirring is satisfied.

2. The image forming apparatus of claim 1, further comprising a detector configured to detect amounts of the toner adhering to different positions on the latent image bearer in a direction perpendicular to a surface-traveling direction thereof, or those after transferred onto another image bearer or the recording material finally, wherein the predetermined increase condition of stirring is a condition that any difference of the amounts of the toner adhering to different positions detected by the detector is over a specified value.

3. The image forming apparatus of claim 2, wherein the detector is an optical sensor.

4. The image forming apparatus of claim 1, wherein each of the first stirring and feeding member and the second stirring and feeding member is a screw member having a rotation axis extending along the developer feeding direction and a blade fixed thereon, and wherein the controller changes the rotation speed of the first feeding screw member or the second feeding screw member.

5. The image forming apparatus of claim 1, wherein the controller changes rotation speed of the second stirring and feeding member without changing rotation speed of the first stirring and feeding member.

6. An image developer, comprising:

a developer container configured to contain a two-component developer, comprising circulation paths comprising a first path through which the developer fed onto the surface of the developer bearer passes and a second path connected with the first path directly;

a developer bearer configured to bear the two-component developer on the surface, to pass the two-component developer through the developing area and to return the two-component developer into the developer container;

a developer stirrer and feeder configured to circulate the two-component developer in the circulation paths while stirring the two-component developer, comprising:

a first stirring and feeding member configured to feed the two-component developer in the first path;

a second stirring and feeding member configured to feed the two-component developer in the second path; and a driver configured to independently drive the first and the second stirring and feeding members, wherein the driver drives the first and the second stirring and feeding members such that an amount of the two-component developer fed by the second stirring and feeding member per unit time is relatively larger than that of the two-component developer fed by the first stirring and feeding member when receiving a predetermined increase condition of stirring.

* * * * *